US011631562B2

(12) United States Patent
Gottschalk et al.

(10) Patent No.: US 11,631,562 B2
(45) Date of Patent: Apr. 18, 2023

(54) CLOSING SPRING ASSEMBLIES FOR ELECTRICAL SWITCHING DEVICES

(71) Applicant: Eaton Intelligent Power Limited, Dublin (IE)

(72) Inventors: Andrew L. Gottschalk, Monaca, PA (US); R. Michael Slepian, Murrysville, PA (US); Xin Zhou, Wexford, PA (US); Santhosh Kumar Chamarajanagar Govinda Nayaka, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 204 days.

(21) Appl. No.: 17/180,068

(22) Filed: Feb. 19, 2021

(65) Prior Publication Data

US 2022/0270839 A1 Aug. 25, 2022

(51) Int. Cl.

| | |
|---|---|
| ***H01H 50/34*** | (2006.01) |
| *H01H 50/20* | (2006.01) |
| *H01H 50/60* | (2006.01) |
| *H01H 50/44* | (2006.01) |

(52) U.S. Cl.

CPC ..... *H01H 50/34* (2013.01); *H01H 50/20* (2013.01); *H01H 50/44* (2013.01); *H01H 50/60* (2013.01)

(58) Field of Classification Search

CPC ..... H01H 50/34; H01H 50/20; H01H 50/44; H01H 50/60

See application file for complete search history.

(56) References Cited

U.S. PATENT DOCUMENTS

| | | | | |
|---|---|---|---|---|
| 3,597,556 | A * | 8/1971 | Sharp | H01H 3/46 218/4 |
| 8,791,779 | B2 * | 7/2014 | Jonsson | H01H 50/323 335/121 |
| 9,183,996 | B2 * | 11/2015 | Karlström et al. | H01H 33/6662 |
| 2020/0243286 | A1 * | 7/2020 | Leccia | H01H 33/664 |
| 2022/0102084 | A1 * | 3/2022 | Freundt | H01H 33/6606 |

OTHER PUBLICATIONS

Peng, C. et al., "A Fast Mechanical Switch for Medium Voltage Hybrid DC and AC Circuit Breakers," IEEE Transactions on Industry Applications, vol. No. 2016.

Peng, C. et al., "Active Damping of Ultrafast Mechanical Switches for Hybrid AC and DC Circuit Breakers," IEEE Transactions on Industry Applications, vol. 53, No. 6, Nov./Dec. 2017, pp. 5354-5364.

* cited by examiner

*Primary Examiner* — Bernard Rojas

(74) *Attorney, Agent, or Firm* — Eckert Seamans Cherin & Mellott, LLC

(57) ABSTRACT

A closing spring assembly for an electrical switching device is provided. The closing spring assembly is configured to exert a closing force on a moving contact of the switching device. The closing force helps to maintain physical and electrical contact between the moving contact and an associated stationary contact, so that the moving and stationary contacts form a path for conducing electric current through the switching device. The closing spring assembly is configured so that the closing force remains constant or decreases as the moving contact is driven away from the stationary contact during switching of the current path away from the moving and stationary contacts.

19 Claims, 8 Drawing Sheets

CLOSING SPRING ASSEMBLIES FOR ELECTRICAL SWITCHING DEVICES

BACKGROUND

This disclosure relates generally to electrical switching devices. More particularly, this disclosure describes a high-speed switching device having a closing spring assembly. The closing spring assembly is configured to exert a closing force on a moving contact of the switching device. The closing force helps to maintain physical and electrical contact between the moving contact and an associated stationary contact, so that the moving and stationary contacts form a path for conducing electric current through the switching device. The closing spring assembly is configured so that the closing force remains constant, or decreases as the moving contact is driven away from the stationary contact during switching of the current path away from the moving and stationary contacts.

High-speed switching devices typically include one or more moving contacts that translate into and out of contact with an associated stationary contact, to selectively establish and disestablish a path for conducting electric current. Under routine operating conditions, the moving contact is held against the stationary contact so that current is transmitted through the switching device by way of the moving and stationary contacts. It may become necessary to rapidly switch the current path during non-routine operating conditions. For example, during an overcurrent condition, the moving and stationary contacts need to be rapidly separated so that the fault current can be shunted to other electrical devices configured to interrupt, reduce, or otherwise handle the fault current. If the moving and stationary contacts are not separated on a nearly instantaneous basis under such conditions, the contacts can experience high current arcing damage, and other electrical devices configured to interrupt may not be able to interrupt the fault current.

Thus, it is desirable to reduce the physical resistance of the moving contact to opening, i.e., to movement away from the stationary contact, because such resistance can reduce the speed of the moving contact and thereby delay the separation of the moving and stationary contacts. The closing force, i.e., the force that urges the moving contact toward the stationary contact, however, needs to be sufficient to cause the moving contact to remain in contact with the stationary during routine operation of the switching device, because unintentional separation of the contacts can result in arcing and an unintentional interruption of the current being transmitted through the switching device.

The closing force in conventional high-speed switching devices typically is provided by a spring such as a toggling Belleville washer, or other types of toggling springs. Due to their toggling action, toggling Belleville washers and toggling springs also produce an opening force, i.e., a force that drives the moving contact away from the stationary contact, once the washer or spring passes its toggling point. In particular, the toggling action causes the closing force to increase substantially as the moving contact translates away from the stationary contact during actuation of the switching device. The closing force reaches its peak as the washer or spring reaches its toggling point, and then reverses direction so as to act as an opening force on the moving contact. The increase in the closing force as the washer or spring is moved toward its toggling position can slow the translation of the moving contact and thereby delay the switching of the current path.

Also, the energy that must be added to a toggling spring to move the spring from its closed position to its toggling point is released as the toggling spring passes the toggling point. This sudden release of energy accelerates the moving contact toward its open position, which can cause rebounding of the moving contact upon reaching its open position. Rebounding can result in arcing, and physical damage to the contact and other components of the switching device.

SUMMARY

In one aspect, the disclosed technology relates to an electrical switching device having a sidewall, a shaft configured to move between a first and a second position in relation to the sidewall, a first contact mounted on the shaft, and a second contact configured to contact the first contact when the shaft is in the first position. The electrical switching device also includes a rotating member coupled to the sidewall and the shaft and configured to rotate between a first and a second position in relation to the sidewall, and a spring coupled to the rotating member and configured to bias the rotating member toward the first position of the rotating member. The rotating member is further configured to exert a force on the shaft in response to the bias of the spring. The force biases the shaft toward the first position of the shaft, and the force remains substantially constant or decreases as the shaft moves from the first to the second position of the shaft.

In another aspect of the disclosed technology, the electrical switching device may further include a first pin configured to couple the rotating member to the sidewall and to the spring. The sidewall may have a first slot formed therein, the rotating member may have a second slot formed therein, and the first pin extends through the first and second slots.

In another aspect of the disclosed technology, the electrical switching device may further include a second pin configured to couple the rotating member to the sidewall, and the rotating member may be further configured to rotate about the second pin.

In another aspect of the disclosed technology, the spring may be a coil spring, and the rotating member may be configured so that, in operation, a longitudinal axis of the spring moves toward the second pin as the rotating member moves from the first to the second position of the rotating member.

In another aspect of the disclosed technology, the first pin may be further configured to translate in relation to the sidewall and the rotating member within the respective first and second slots as the rotating member moves from the first to the second position of the rotating member.

In another aspect of the disclosed technology, the shaft may be configured to move between the first and second positions of the shaft in a horizontal direction, and the rotating member may be configured so that the first pin remains lower than the second pin as the rotating member moves from the first to the second position of the rotating member.

In another aspect of the disclosed technology, the shaft may be configured to move between the first and second positions in a horizontal direction, and the second slot may have a substantially horizontal orientation when the rotating member is in the first position of the rotating member.

In another aspect of the disclosed technology, the electrical switching device may further include a third pin. The third pin may be configured to couple a first end of the spring to the sidewall; and the first pin is further configured to couple a second end of the spring to the sidewall and to the rotating member.

In another aspect of the disclosed technology, the electrical switching device may further include a plunger mounted on the shaft, and a coil configured to generate a force that repels the plunger from the coil and thereby moves the shaft from the first to the second position of the shaft.

In another aspect of the disclosed technology, the sidewall may be a first sidewall, the spring may be a first spring, and the rotating member may be a first rotating member. The electrical switching device may further include a second sidewall, a second spring, and a second rotating member. The first pin may be further configured to couple the first and second rotating members to the first and second sidewalls and to the first and second springs. The second pin may be further configured to couple the first and second rotating members to the first and second sidewalls.

In another aspect of the disclosed technology, the spring may be configured to stretch as the rotating member rotates from the first to the second position of the rotating member.

In another aspect of the disclosed technology, the shaft may include a first and a second flange, the rotating member may include a body and an arm extending from the body, and an end the arm may be configured to be positioned between the flanges and to exert the force on one of the flanges.

In another aspect of the disclosed technology, the second slot may be formed in the body.

In another aspect of the disclosed technology, the first contact may be spaced apart from the second contact when the shaft is in the second position of the shaft.

In another aspect of the disclosed technology, a closing spring assembly for an electrical switching device is provided. The electrical switching device includes a first contact, a second contact, a drive configured to move the first contact away from the second contact, and a sidewall having a first slot formed therein.

The closing spring assembly may include a shaft configured to move between a first and a second position in relation to the sidewall. A first end of the shaft may be configured to have the first contact mounted thereon, and a second end of the shaft may be configured to be connected to the drive. The closing spring assembly also may include a rotating member having a second slot formed therein. The rotating member may be configured to be coupled to the sidewall and to the shaft, and to rotate between a first and a second position in relation to the sidewall. The closing spring assembly may further include a spring coupled to the rotating member and configured to bias the rotating member toward the first position of the rotating member, and a first pin configured to couple the rotating member to the sidewall and to the spring. The first pin may be further configured to be positioned within the first and second slots. The closing spring assembly also may include a second pin configured to couple the rotating member to the sidewall. The rotating member may be further configured to rotate about the second pin.

In another aspect of the disclosed technology, the rotating member may be further configured to exert a force on the shaft in response to the bias of the spring. The force may bias the shaft toward the first position of the shaft, and the force may remain substantially constant, or decrease as the shaft moves from the first to the second position of the shaft.

In another aspect of the disclosed technology, the spring may be a coil spring, and the rotating member may be further configured so that a longitudinal axis of the spring moves toward the second pin as the rotating member moves from the first to the second position of the rotating member.

In another aspect of the disclosed technology, the first pin may be configured to translate in relation to the sidewall and the rotating member within the respective first and second slots as the rotating member moves from the first to the second position of the rotating member.

In another aspect of the disclosed technology, the shaft may be configured to move between the first and second positions in a horizontal direction, and the rotating member may be configured so that the first pin remains lower than the second pin as the rotating member moves from the first to the second position of the rotating member.

In another aspect of the disclosed technology, the shaft may be configured to move between the first and second positions in a horizontal direction, and the second slot may have a substantially horizontal orientation when the rotating member is in the first position of the rotating member.

DETAILED DESCRIPTION

Figure 1:
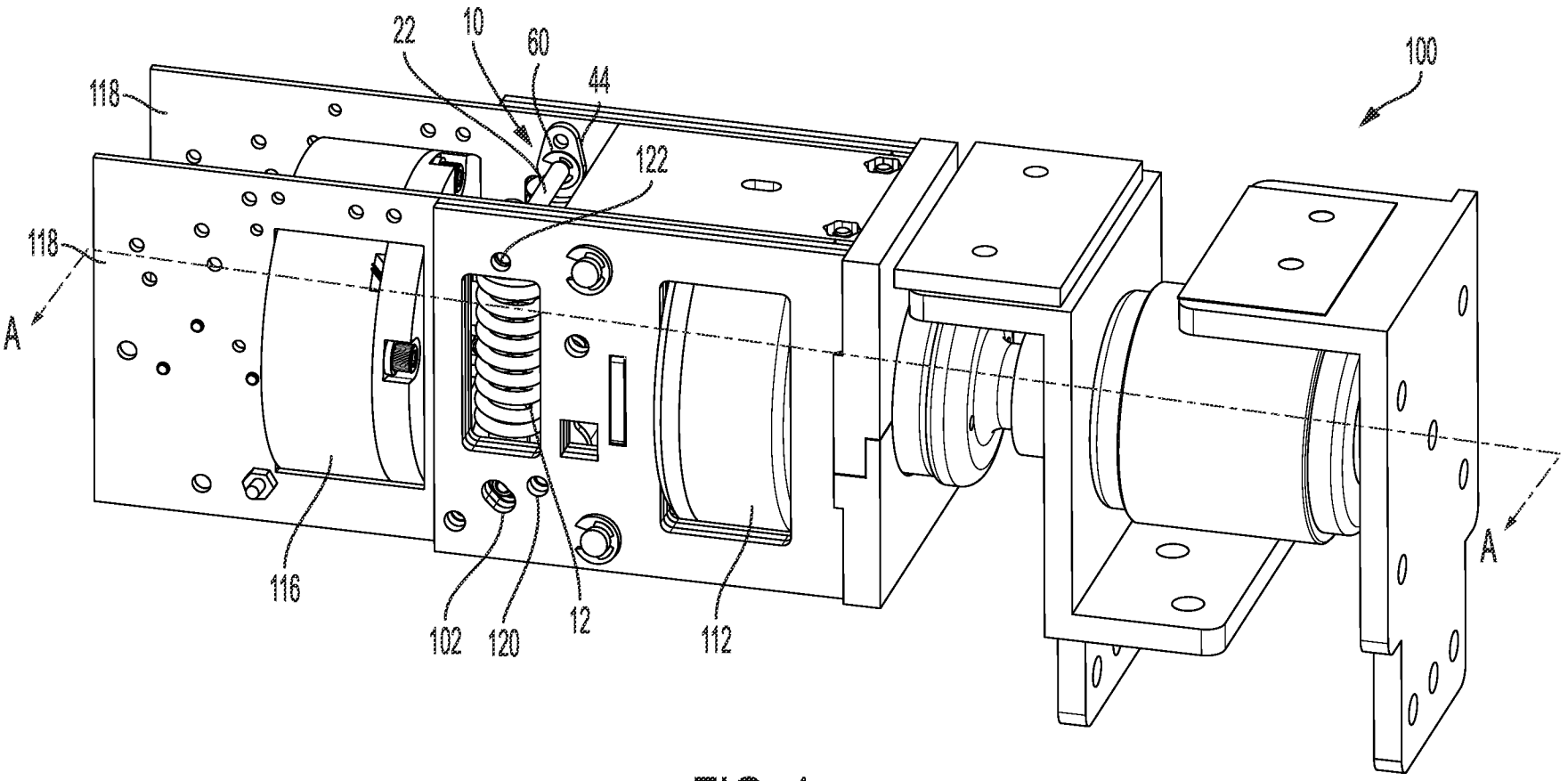
FIG. 1 is an upper-front perspective view of a switching device in the form of an electrical switch.
Figure 2:
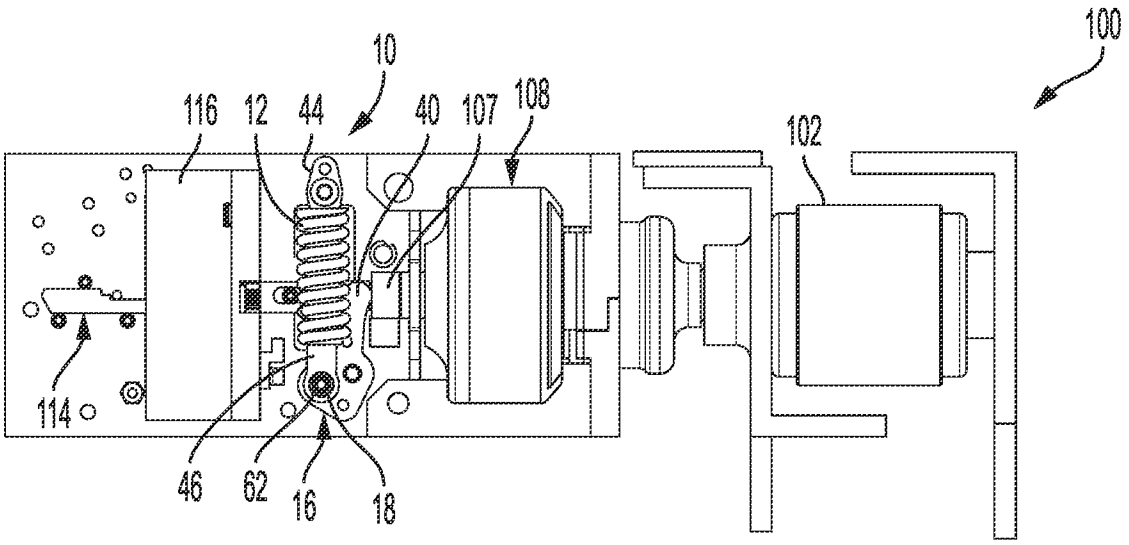
FIG. 2 is a side view of the electrical switch shown in FIG. 1, with a sidewall of the electrical switch removed for clarity of illustration, and depicting a switch shaft and a spring fork of a closing spring assembly of the electrical switch in their respective closing positions.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

Other terms that are relevant to this disclosure will be defined at the end of this Detailed Description section.

FIGS. 1-8 depict a closing spring assembly 10 for a switching device such an electrical switch 100. Referring initially to FIGS. 1-4, the switch 100 comprises a switching assembly 102 configured to form a current path between a first and a second terminal (not shown) of the switch 100. The switching assembly 102 includes a first, or moving contact 104; and a second, or stationary contact 106, visible in FIG. 3. The moving contact 104 is securely mounted on a first end of a shaft in the form of a switch shaft 114; and is configured to translate linearly, between a first, or closed position depicted in FIG. 3, and a second, or open position (not shown). The moving contact 104, when in the closed position, is in physical and electrical contact with the stationary contact 106, thereby facilitating the flow of electric current between the first and second terminals. When in the open position, the moving contact 104 is spaced apart, and electrically isolated from the stationary contact 106; thus, current does not flow thorough the switch 100 when the moving contact 104 is in the open position.

Figure 3:
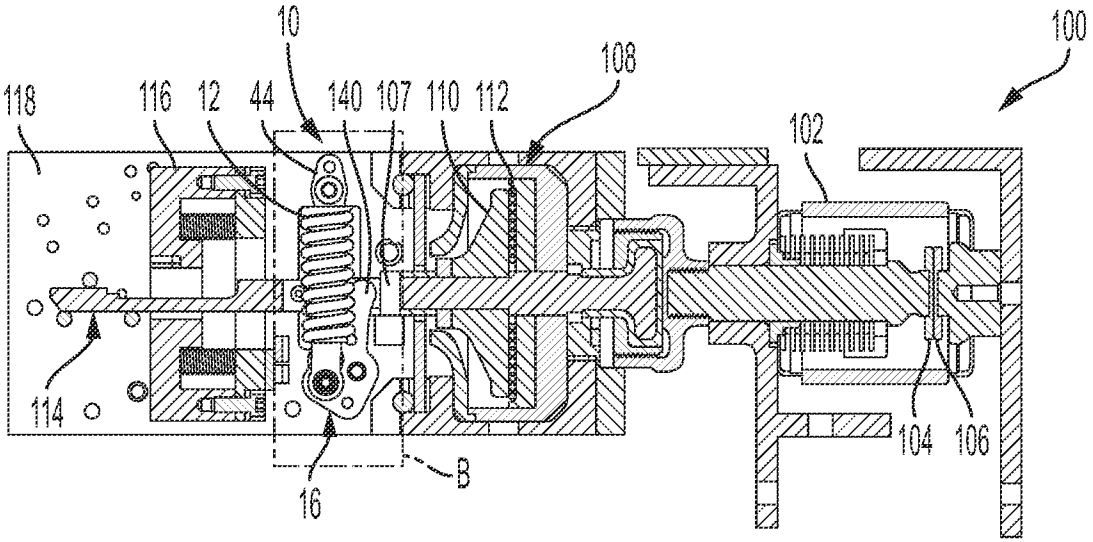
FIG. 3 is a cross-sectional view of the electrical switch shown in FIGS. 1 and 2, taken through the line A-A of FIG. 1, and depicting a moving contact of the electrical switch in a closed position, and further depicting the switch shaft and spring fork of the closing spring assembly in their respective closing positions.

The switch 100 also includes a drive 108 configured to actuate the switching assembly 102. As can be seen in FIG. 3, the drive 108 includes a plunger 110; a high-speed or primary coil 112 located adjacent the plunger 110; and a low-speed or secondary coil 116. The plunger 110 is securely connected to a second end of the switch shaft 114. The primary coil 112 generates a varying magnetic flux when energized with a pulsating electric current. The magnetic flux induces an oppositely flowing electric current within the plunger 110. The opposing currents generate a repulsive force between the primary coil 112 and the plunger 110. The repulsive force rapidly drives the plunger 110, and the attached switch shaft 114, away from the primary coil 112. The primary coil 112 is a Thomson coil; other types of coils can be used in alternative embodiments.

The switch shaft 114 is configured to translate linearly between a first, or closing position and a second, or opening position. When in the closing position, the switch shaft 114 urges the moving contact 104 into its closed position against the stationary contact 106. When in the opening position, the switch shaft 114 holds the moving contact 104 is its open position, spaced apart from the stationary contact 106.

The switch shaft 114 resides in its closing position, depicted in FIGS. 2, 3, 4A, and 7, when the primary coil 112 and the secondary coil 116 are not energized. The movement of plunger 110 in response to energization of the primary coil 112 causes the switch shaft 114 to translate linearly, to its opening position, which in turn causes the moving contact 104 to translate rapidly toward its open position. The moving contact 104 is opened in this manner when it is necessary to rapidly separate the moving contact 104 from the stationary contact 106, such as upon the detection of an overcurrent condition.

The secondary coil 116 configured to move the switch shaft 114 to its opening position at a much slower rate than the primary coil 112. The secondary coil 116 is used to move the moving contact 104 under routine circumstances that do not require the nearly instantaneous separation of the moving contact 104 and the stationary contact 106 provided by the primary coil 112.

The switch 100 also includes two side plates 118 located on opposite sides of the switch 100, as shown in FIG. 1.

The closing spring assembly 10 biases the switch shaft 114 toward its closing position, and maintains the moving contact 104 in its closed position during routine operation of the switch 100, i.e., when the primary coil 112 and the secondary coil 116 are de-energized and current is being transferred through the switch 100 by way of the moving contact 104 and the stationary contact 106. Referring FIGS. 4A-8, the closing spring assembly 10 comprises two springs in the form of closing springs 12; two rotating members, or spring forks 16; and the switch shaft 114. The closing spring assembly 10 also comprises a first pin, or moving spring pin 18; a second pin, or spring fork pivot pin 20; and a third pin, or stationary spring pin 22.

Figure 6:
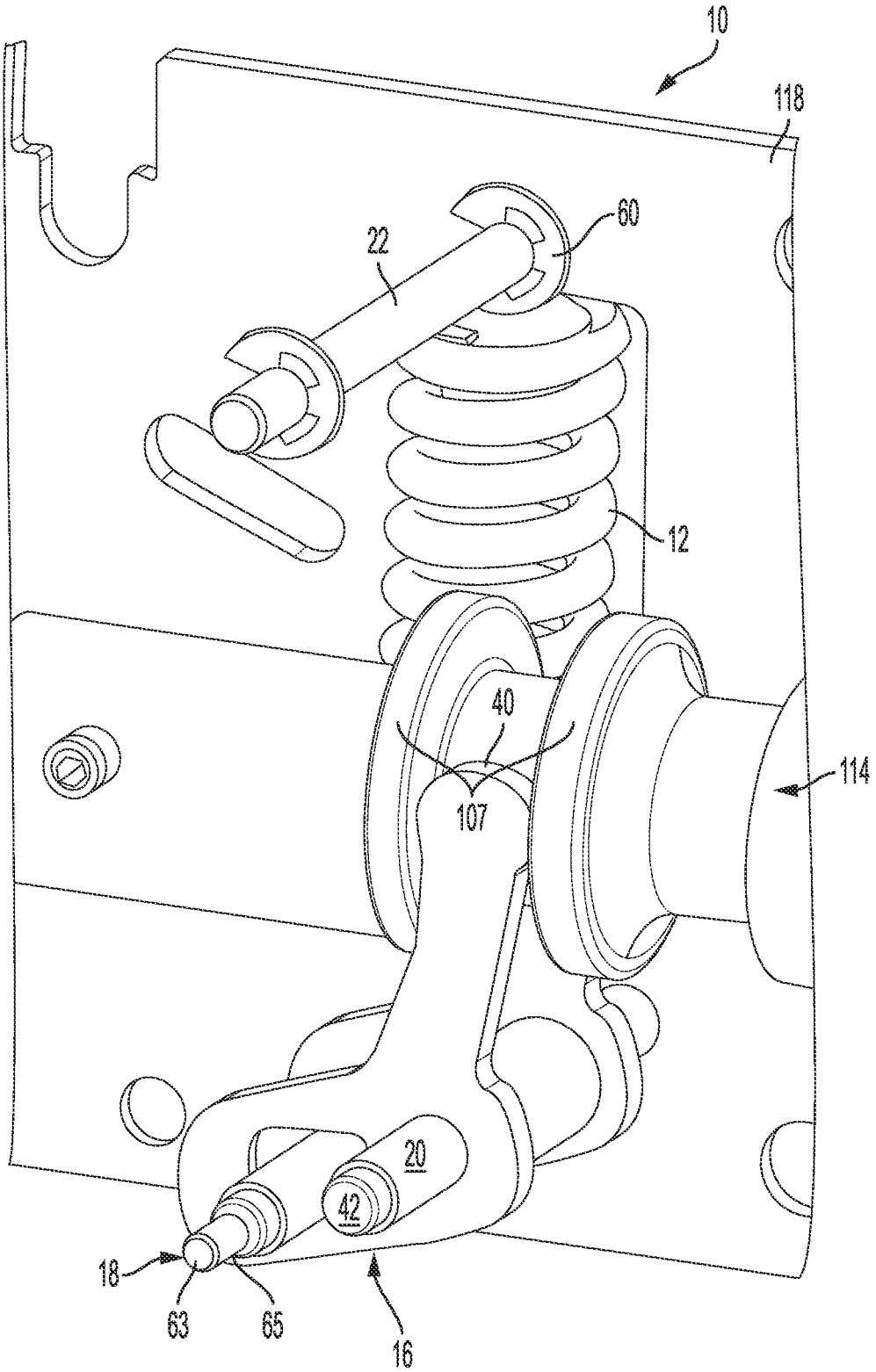
FIG. 6 is a magnified view of the area designated "B" in FIG. 3, with a spring of the closing spring assembly of the electrical switch removed for clarity of illustration.
Figure 7:
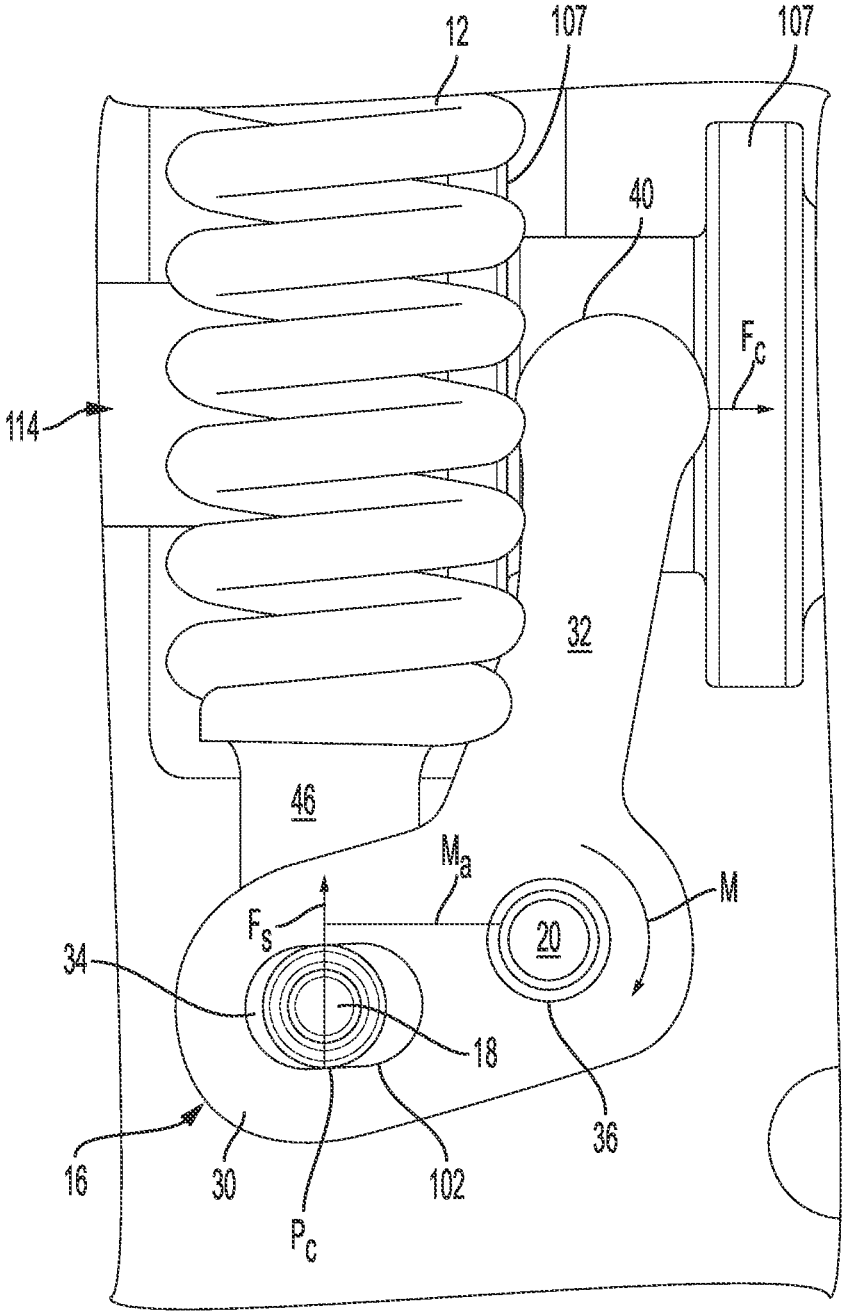
FIG. 7 is a magnified view of the area designated "C" in FIG. 5, depicting the switch shaft and spring fork of the closing spring assembly in their respective closing positions, with the spring fork pictured outboard of a lower flange of the closing spring assembly for clarity of illustration.
Figure 8:
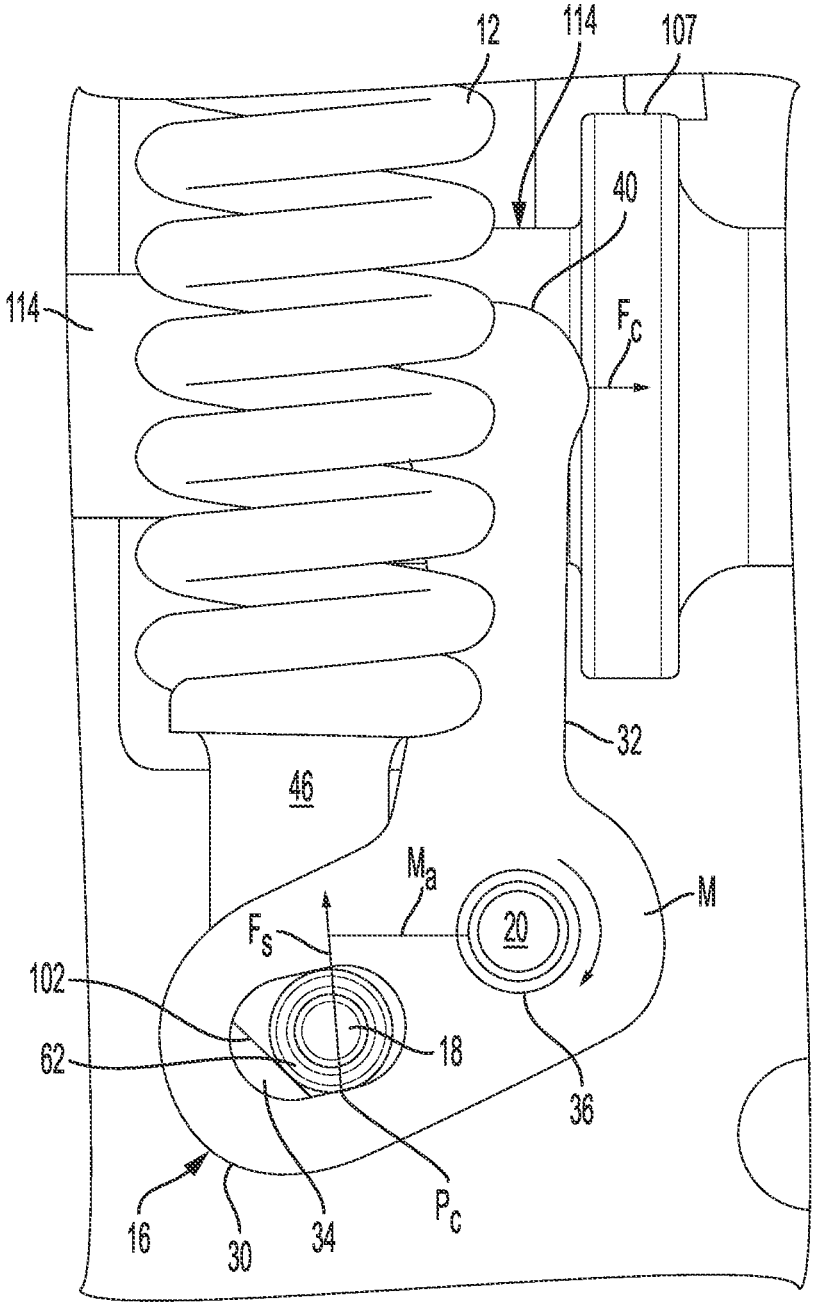
FIG. 8 is a magnified view of the area designated "C" in FIG. 5, depicting the switch shaft and the spring fork in their respective opening positions.

The spring forks 16 are configured to rotate in relation to the side plates 118 between a first, or closing position shown in FIGS. 2, 3, 4A, and 5-7; and a second, or opening position shown in FIG. 8. The spring forks 16 are coupled to the closing springs 12 by the moving spring pin 18. The spring forks 16 are coupled to the side plates 118 by the spring fork pivot pin 20; and are configured to rotate, or pivot, in relation to the side plates 118 on the spring fork pivot pin 20.

The spring forks 16 transmit the spring force of the closing springs 12 to the switch shaft 114, and thereby bias the switch shaft 114 toward its closing position. More specifically, the springs 12 are configured to remain in tension, and to exert a combined spring force on the spring forks 16 by way of the moving spring pin 18. The combined spring force is designated "$F_s$" in FIGS. 7 and 8. The spring force $F_s$ generates a moment on the spring forks 16. This moment is designated "M" in FIGS. 7 and 8, and acts in a clockwise direction from the perspective of these figures.

As a result of the moment M, the spring forks 16 exert a force on the switch shaft 114. This force is represented by the character "$F_c$" in FIGS. 7 and 8, and acts to the right from the perspective of these figures. The force $F_c$, through the switch shaft 114, urges the moving contact 104 into contact with the stationary contact 106, and thus acts as a closing force for the switch 100. The closing spring assembly 10 is configured so that the closing force $F_c$ remains substantially constant, or decreases, as the spring forks 16 and the switch shaft 114 move toward their respective opening positions, notwithstanding that the closing springs 12 stretch and thereby generate additional spring force under such conditions. Because the closing force $F_c$ remains substantially constant, or decreases, as the switch shaft 114 moves toward its opening position, the effect of the closing spring assembly 10 on the opening speed of the switch 100 is minimal, i.e., the closing spring assembly 10 does not substantially impede the rapid movement of the moving contact 104 toward its open position in response to energization of the primary coil 112. In particular, as discussed below, the side plates 118 exert a camming action on the spring forks 16 by way of the moving spring pin 18. The camming action causes a reduction in the moment arm through which the spring force $F_s$ is applied to the spring forks 16 as the switch shaft 114 moves toward its opening position. As a result of reduction in the moment arm, the closing force remains constant, or decreases, as the switch shaft 114 moves toward its opening position. In addition, the camming action causes the closing springs 12 to undergo less stretching than otherwise would occur without the camming action, as the switch shaft 114 moves toward its opening position. The decreased stretching results in less torque being applied to the spring forks 16, which further helps to reduce the closing force $F_c$ as the switch shaft 114 moves toward its opening position.

The moving spring pin 18 extends through first slots, or slots 102 formed in the side plates 118; and second slots, or slots 34 formed in the spring forks 16. The slots 34 and the slots 102 permit the moving spring pin 18 to move toward the spring fork pivot pin 20, i.e., toward the axis of rotation of the spring forks 16, as the closing springs 12 stretch in response to rotation of the spring forks 16 toward their opening positions.

As a result of the movement of the moving spring pin 18 toward the axis of rotation of the spring forks 16, the moment M exerted on the spring forks 16 by the closing springs 12 remains substantially constant or decreases, resulting in a substantially constant, or decreasing, closing force $F_c$ as the spring forks 16, and the switch shaft 114, move toward their respective opening positions. Also, the movement of the moving spring pin 18 facilitated by the slots 34 and the slots 102 helps to minimize the stretching, i.e., extension, of the closing springs 12 as the spring forks 16 rotate toward their opening positions. Because the closing force $F_c$ remains substantially constant, or decreases, and the stretching of the closing springs 12 is minimal, the closing spring assembly 10 does not substantially slow down or otherwise impede the rapid movement of the moving contact 104 away from the stationary contact 106 when the primary coil 112 is energized.

Referring to FIGS. 4A-8, each spring fork 16 includes a body 30, and an arm 32 that adjoins the body 30. The slot 34 of the spring fork 16 is located in the body 30. The body 30 also has a circular hole 36 formed therein. The hole 36 receives the spring fork pivot pin 20. The hole 36 sized to accept the spring fork pivot pin 20 with minimal clearance between the outer surface of the spring fork pivot pin 20 the periphery of the hole 36, so that the spring fork pivot pin 20 can rotate in relation to the body 30.

End portions 42 of the spring fork pivot pin 20 are positioned within holes 120 formed in the side plates 118. The holes 120 are visible in FIGS. 1 and 4. The end portions 42 have a reduced diameter in relation to the remainder of the spring fork pivot pin 20, as can be seen in FIGS. 5 and 6. The holes 120 are sized to accept the end portions 42 with minimal clearance between the outer circumference of the end portions 42 and the periphery of the holes 120, so that the spring fork pivot pin 20 can rotate in relation to the side panels 100. The holes 120, and the holes 36 in the spring forks 16 are positioned so that the centerline of the spring fork pivot pin 20 remains higher than the centerline of the moving spring pin 18, from the perspective of FIGS. 5-8, as the spring forks 16 rotate between their closing and opening positions.

The slot 34 in each spring fork 16 receives the moving spring pin 18. The slot 34 is sized to accept the moving spring pin 18 with minimal clearance between the outer surface of the moving spring pin 18 and the periphery of the slot 34, so that the moving spring pin 18 can translate within the slot 34 with a rolling or sliding motion. In alternative embodiments, the moving spring pin 18 can contact the periphery of the slots 34 by way of rollers, to reduce friction between the moving spring pin 18 and the spring forks 16.

Each slot 34 can has a length sufficient to permit the moving spring pin 18 to move freely back and forth within the slots 102 of the sidewall 118. Also, each slot 34 can have an orientation such that the longitudinal axis of the slot 34 is approximately perpendicular to the longitudinal axes of the closing springs 12 when the spring forks 16 are in their closing positions, as shown in FIG. 7. This orientation helps to maximize the force transmitted between the closing springs 12 and the switch shaft 114 when the switch shaft 114 is in the closing position, thereby helping to maximize the closing force $F_c$ exerted on the moving contact 104 when the moving contact 104 is in its closed position.

Figure 4:
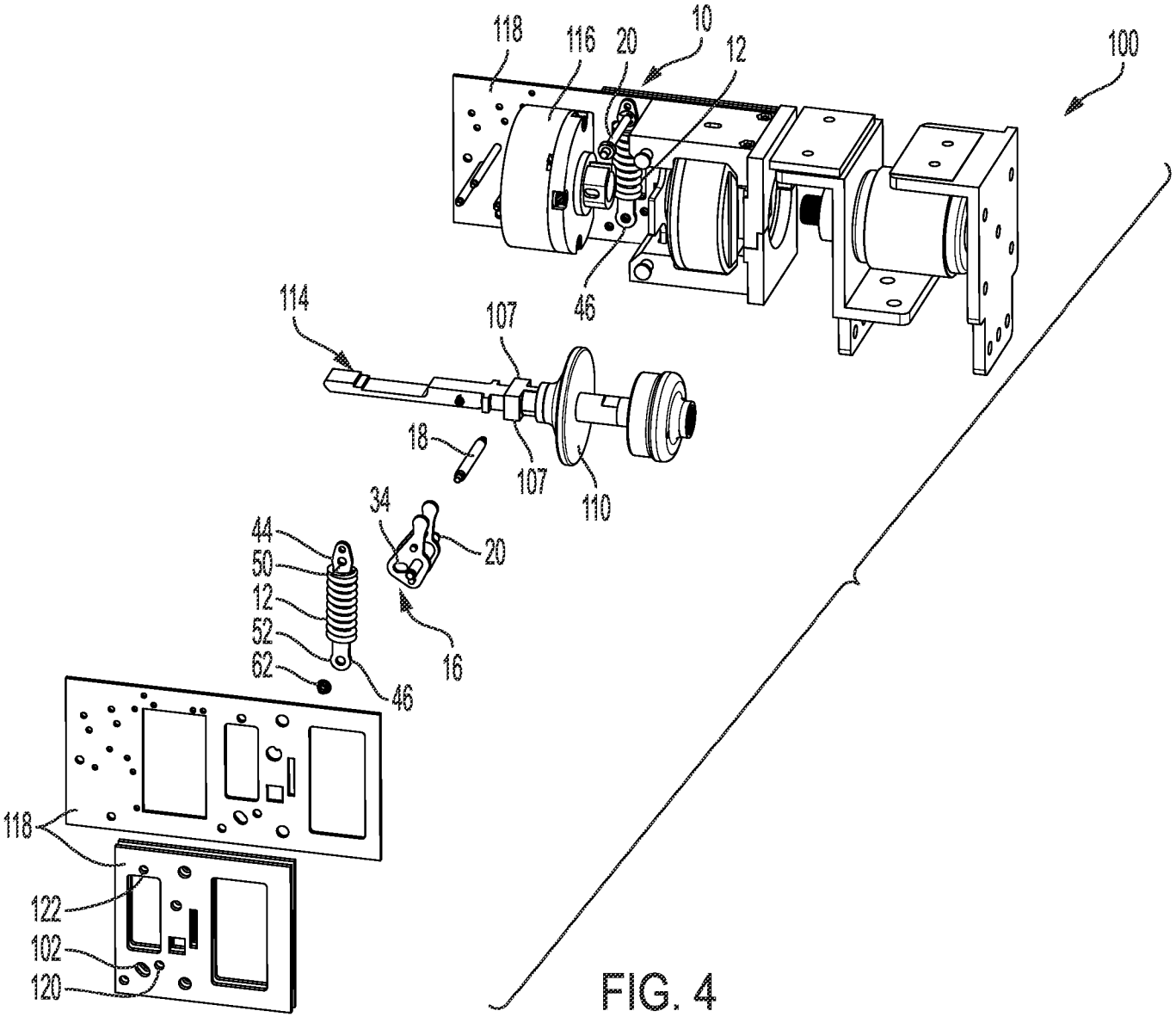
FIG. 4 is a partially exploded perspective view of the electrical switch shown in FIGS. 1-3.
Figure 5:
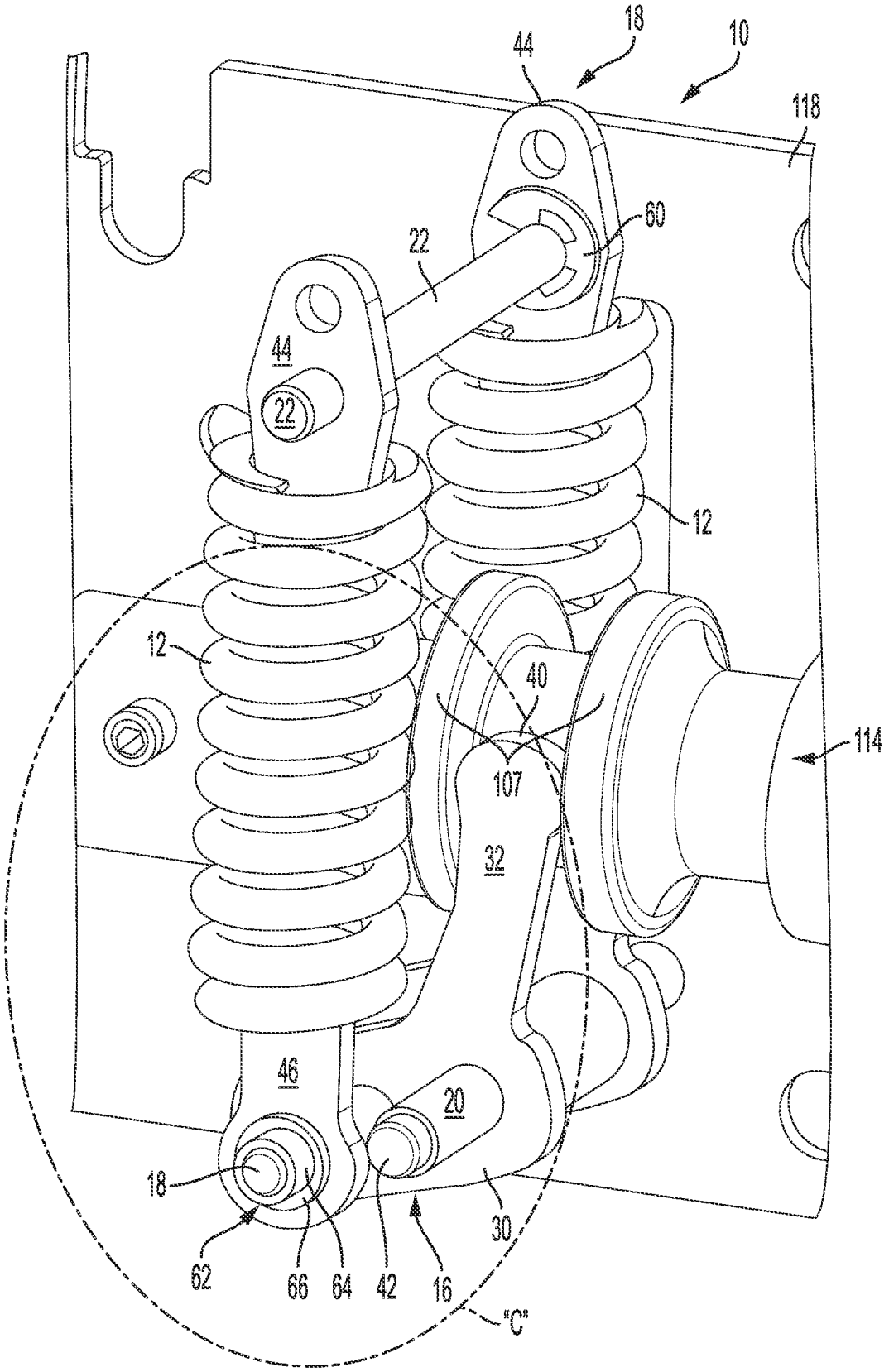
FIG. 5 is a magnified view of the area designated "B" in FIG. 3.

The switch shaft 114 has two flanges 107, as can be seen in FIGS. 4-6. A freestanding end portion 40 of the arm 32 is positioned between the flanges 107. The end portion 40 has a rounded outer periphery, and is sized to fit between the flanges 107 with minimal clearance between its outer periphery and the flanges 106. Force is transmitted between the spring forks 16 and switch shaft 114 by the contacting surfaces of the end portion 40 and the flanges 107.

The closing springs 12 are tension coil springs. Other types of springs can be used in alternative embodiments. Referring to FIG. 5, each closing spring 12 is coupled to the stationary spring pin 22 by an associated upper flange 44. Each closing spring 12 is coupled to the moving spring pin 18 by an associated lower flange 46.

Figure 4A:
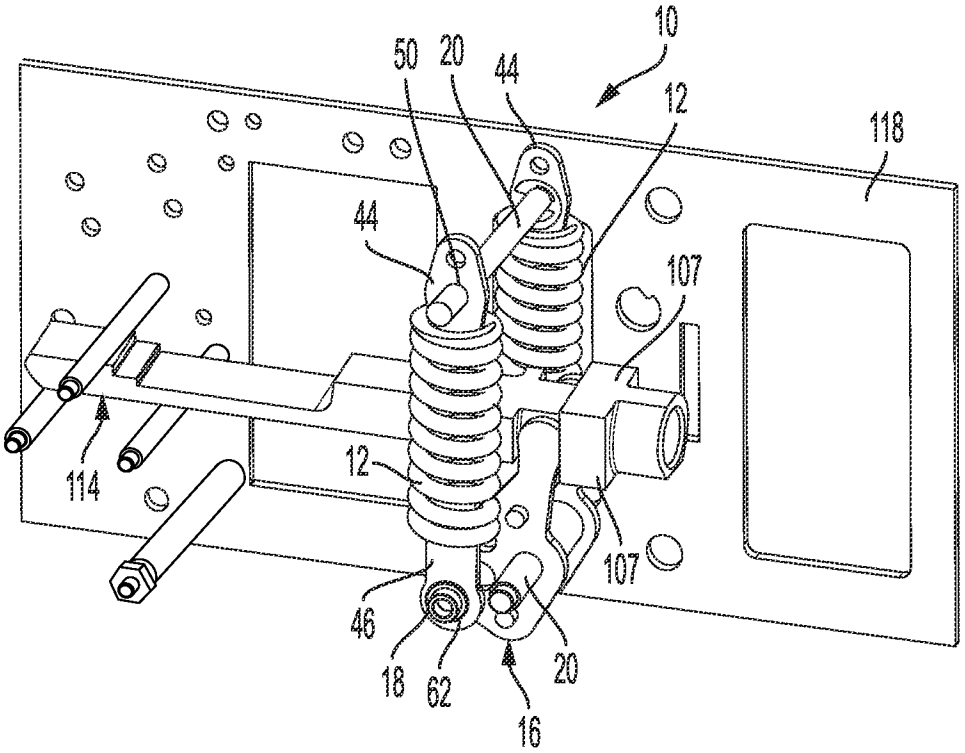
FIG. 4A is an upper-front perspective view of a closing spring assembly of the switching device view of the electrical switch shown in FIGS. 1-4, depicting the switch shaft and spring fork of the closing spring assembly in their respective closing positions.

Each upper flange 44 is securely connected to an upper end of its associated closing spring 12 by a suitable means such as hook-shaped extensions or lips (not shown) that protrude from the upper flange 44. The upper flange 44 and the closing spring 12 can be unitarily formed in alternative embodiments. The upper flanges 44 each have a hole 50 formed therein, as shown in FIG. 4A. The hole 50 receives the stationary spring pin 22. The hole 50 sized to accept the stationary spring pin 22 with minimal clearance between the outer surface of the stationary spring pin 22 the periphery of the hole 50, so that the stationary spring pin 22 can rotate in relation to the upper flanges 44.

Each lower flange 46 is securely connected to a lower end of its associated closing spring 12 by a suitable means such as hook-shaped extensions or lips (not shown) that protrude from the lower flange 46. The lower flange 46 and the closing spring 12 can be unitarily formed in alternative embodiments. The lower flanges 46 each have a hole 52 formed therein, as shown in FIG. 4. The hole 52 receives the moving spring pin 18. The hole 52 sized to accept the moving spring pin 18 with minimal clearance between the outer surface of the moving spring pin 18 the periphery of the hole 52, so that the moving spring pin 18 can rotate in relation to the lower flanges 46.

Each closing spring 12 is coupled to the side plates 118 by way of its associated upper flange 44, and the stationary spring pin 22. The side plates 118 each have a hole 122 formed therein, as shown in FIGS. 1 and 4. The hole 122 receives the stationary spring pin 22. The hole 122 sized to accept the stationary spring pin 22 with minimal clearance between the outer surface of the stationary spring pin 22 the periphery of the hole 122, so that the stationary spring pin 22 can rotate in relation to the side plates 118. The stationary spring pin 22 is restrained from lateral, or side to side movement in relation to the upper flanges 44 by two e-clips 60 that engage corresponding grooves formed in the stationary spring pin 22, inboard of the upper flanges 44. The e-clips 60 are visible in FIGS. 4-6.

The closing springs 12 are further coupled to the side plates 118 by way of their associated lower flanges 46, the moving spring pin 18, and two rollers 62. The rollers 62 are positioned over the respective ends of the moving spring pin 18, as depicted in FIG. 5. The ends of the moving spring pin 18 each have a reduced diameter portion 63 to accommodate the associated roller 62, as can be seen in FIG. 6. The inner diameter of each roller 62 is selected so that the roller 62 fits over the reduced diameter portion 63 of the associated moving spring pin 18 with minimal clearance between the adjacent surfaces of the roller 62 and the moving spring pin 18, so that the roller 62 can rotate in relation to the moving spring pin 18.

Each roller 62 is positioned, in part, within an associated one of the slots 102 in the side plates 118. Referring to FIG. 5, the rollers 62 each have a circular outer surface 64 that contacts the peripheral surface of the associated slot 102. The diameter of the outer surface 64 is selected so that minimal clearance exists between the outer surface 64 and the periphery of the slot 102, allowing the roller 62 to translate within the slot 102 with a rolling or sliding motion that helps to minimize friction between the moving spring pin 18 and the side plates 118.

The moving spring pin 18 is restrained from lateral movement in relation to the lower flanges 46 and the sidewalls 118 by lips or flanges 65 formed in the moving spring pin 18, adjacent the reduced diameter portions 63, as show in FIG. 6. Also, each roller 62 has a circular lip or flange 66. The lip 66 is located between the side plate 118 and the associated lower flange 46, and thereby restrains the roller 62 from lateral in relation to its associated side plate 118 and lower flange 65.

In alternative embodiments, the closing springs 12 can be standard tension springs connected directly to the stationary spring pin 22 and the moving spring pin 18, without the upper and lower flanges 44, 46. In particular, the upper and lower ends of the each closing spring 12 can be extended, and can have hooked portions formed therein to directly engage the respective stationary spring pin 22 and moving spring pin 18.

During operation, the closing spring assembly 10 causes the switch shaft 114 to return to its closing position when the primary coil 112 and the secondary coil 116 are de-energized, i.e., when the primary coil 112 and the secondary coil 116 are no longer generating a force that drives the switch shaft 114 toward its closing position. Also, the closing spring assembly 10 biases the switch shaft 114 toward its closing position, thereby causing the switch shaft 114 to remain in its closing position until the primary coil 112 or the secondary coil 116 are re-energized to drive the switch shaft 114 to its opening position. The closing force $F_c$ acting on the switch shaft 114 is generated by the closing springs 12, which remain in tension as the spring forks 16 rotate about the centerline of the spring fork pivot pin 20 between their closing and opening positions. The combined force $F_s$ of the closing springs 12 is transmitted to the spring forks 16 by way of the moving spring pin 18, and produces the clockwise moment M on the spring forks 16, as shown in FIGS. 7 and 8. The moment M, in turn, causes the spring forks 16 to exert the closing force $F_c$ on the switch shaft 114, which urges the switch shaft 114 toward its closing position.

The closing springs 12 stretch as the spring forks 16 rotate from the closing position to the opening position, which in turn results in an increase in the combined spring force $F_s$ generated by the closing springs 12. The closing force $F_c$ opposes the movement of the moving contact 104 toward its open position, and thus has the potential to slow the separation of the moving contact 104 from the stationary contact 106. It is desirable, therefore, to minimize or eliminate any increase in the closing force $F_c$ as the moving contact 104 is driven toward its opening position.

The closing spring assembly 10 is configured so that the closing force $F_c$ remains substantially constant, or decreases, as the switch shaft 114 moves from its closing position to its opening position. In particular, the axis of rotation of the spring forks 16 coincides with the centerline of the spring fork pivot pin 20. The spring force $F_s$ is applied to the spring forks 16 at the point of contact $P_c$ between the moving spring shaft 18 and the spring forks 16. The point of contact is designated "$P_c$," and the moment arm through which the spring force $F_s$ is applied is represented by the reference line "$M_a$" in FIGS. 7 and 8. The resulting moment M exerted on the spring forks 16 is equal to the product of the spring force $F_s$ and the length of the moment arm $M_a$.

As can be seen in FIGS. 7 and 8, the length of the moment arm $M_a$ decreases as the spring forks rotate 16 toward their opening position shown in FIG. 8. This decrease occurs because the centerline of the moving spring pin 18 remains lower than the centerline of the spring fork pivot pin 20 as the spring forks 16 rotate in the counterclockwise direction from the perspective of FIGS. 7 and 8, which in turn causes the point of contact $P_c$ between the moving spring pin 18 and the spring forks 16 to move to the right. The moment arm $M_a$ also decreases due to the rightward translation of the moving spring pin 18 within the slots 102.

The decrease in the moment arm $M_a$ causes the moment M exerted on the spring forks 16 by the closing springs 12 to remain substantially constant, or decrease, as the spring forks 16 rotate from the closed position to the open position, notwithstanding the progressive increase in the combined spring force $F_s$ exerted on the spring forks 16. Because the moment M remains substantially constant, or deceases, the resulting closing force $F_c$ exerted on the switch shaft 114 also remains substantially constant, or decreases, as the switch shaft 114 moves to its opening position and draws the moving contact 104 away from the stationary contact 106. Thus, the closing spring assembly 10 is capable of exerting a substantial closing force that can prevent inadvertent separation of the contacts, without substantially decreasing the speed at which the moving contact 104 can be separated from the stationary contact 106 during actuation of the switching device 100. In some embodiments, the closing force $F_c$ may decrease by about zero to about 15 percent as the switch shaft 114 moves from its closing position to its opening position.

The orientations of the slots 102 of alternative embodiments can be selected so that the closing force $F_c$ decreases as the switch shaft 114 moves from is closing position to its opening position. In particular, the above-noted decrease in the moment arm $M_a$ as the spring forks 16 rotate toward their closing position can be amplified by configuring the slots 102 to have a more horizontal orientation than that depicted in FIGS. 1 and 4; although too shallow an orientation is undesirable because it can prevent the moving spring pin 18 from translating with the slots 102 due to the effects of friction acting on the moving spring pin 18.

In this document, when terms such "first" and "second" are used to modify a noun, such use is simply intended to distinguish one item from another, and is not intended to require a sequential order unless specifically stated. The term "substantially," when used in connection with a numeric value, is intended to include values that are close to, but not exactly, the number. For example, in some embodiments, the term "substantially" may include values that are within +/−ten percent of the value.

In this document, the term "electrically connected", when referring to two electrical components, means that a conductive path exists between the two components. The path may be a direct path, or an indirect path through one or more intermediary components.

When used in this document, relative terms of position such as "up" and "down", "upper" and "lower", and "upward" and "downward" are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The features and functions described above, as well as alternatives, may be combined into many other different systems or applications. Various alternatives, modifications, variations or improvements may be made by those skilled in the art, each of which is also intended to be encompassed by the disclosed embodiments.

We claim:

1. An electrical switching device, comprising:

a sidewall;

a shaft configured to move between a first and a second position in relation to the sidewall;

a first contact mounted on the shaft;

a second contact configured to contact the first contact when the shaft is in the first position;

a rotating member coupled to the sidewall and the shaft and configured to rotate between a first and a second position in relation to the sidewall;

a spring coupled to the rotating member and configured to bias the rotating member toward the first position of the rotating member; and a first pin configured to couple the rotating member to the sidewall and to the spring, wherein:

the rotating member is further configured to, during operation, exert a force on the shaft in response to the bias of the spring;

the force will bias the shaft toward the first position of the shaft;

the force will remain substantially constant or decreases as the shaft moves from the first to the second position of the shaft;

the sidewall has a first slot formed therein;

the rotating member has a second slot formed therein; and the first pin extends through the first and second slots.

2. The device of claim 1, further comprising a second pin configured to couple the rotating member to the sidewall, wherein the rotating member is further configured to rotate about the second pin.

3. The device of claim 2, wherein:

the spring is a coil spring; and the rotating member is configured so that, during operation, a longitudinal axis of the spring will move toward the second pin as the rotating member moves from the first to the second position of the rotating member.

4. The device of claim 1, wherein the first pin is further configured to, during operation, translate in relation to the sidewall and the rotating member within the respective first and second slots as the rotating member moves from the first to the second position of the rotating member.

5. The device of claim 2, wherein:

the shaft is configured to, during operation, move between the first and second positions of the shaft in a horizontal direction; and the rotating member is configured so that the first pin remains lower than the second pin as the rotating member moves from the first to the second position of the rotating member during operation.

6. The device of claim 1, wherein:

the shaft is configured to, during operation, move between the first and second positions in a horizontal direction; and the second slot has a substantially horizontal orientation when the rotating member is in the first position of the rotating member.

7. The device of claim 2, further comprising a third pin, wherein:

the third pin is configured to couple a first end of the spring to the sidewall; and the first pin is further configured to couple a second end of the spring to the sidewall and to the rotating member.

8. The device of claim 1, further comprising:

a plunger mounted on the shaft; and a coil configured to generate a force that, during operation, will repel the plunger from the coil and thereby move the shaft from the first to the second position of the shaft.

9. The device of claim 2, wherein:

the sidewall is a first sidewall;

the spring is a first spring;

the rotating member is a first rotating member;

the device further comprises a second sidewall, a second spring, and a second rotating member;

the first pin is further configured to couple the first and second rotating members to the first and second sidewalls and to the first and second springs; and the second pin is further configured to couple the first and second rotating members to the first and second sidewalls.

10. The device of claim 1, wherein the spring is configured to stretch as the rotating member rotates from the first to the second position of the rotating member during operation.

11. The device of claim 1, wherein:

the shaft comprises a first and a second flange;

the rotating member comprises a body and an arm extending from the body; and an end the arm is configured to be positioned between the flanges and to exert the force on one of the flanges during operation.

12. The device of claim 11, wherein the second slot is formed in the body.

13. The device of claim 1, wherein the first contact is spaced apart from the second contact when the shaft is in the second position of the shaft.

14. A closing spring assembly for an electrical switching device, the electrical switching device comprising a first contact, a second contact, a drive configured to move the first contact away from the second contact, and a sidewall having a first slot formed therein, the closing spring assembly comprising:

a shaft configured to move between a first and a second position in relation to the sidewall, wherein a first end of the shaft is configured to have the first contact mounted thereon, and a second end of the shaft is configured to be connected to the drive;

a rotating member having a second slot formed therein, the rotating member being configured to be coupled to the sidewall and to the shaft, and to rotate between a first and a second position in relation to the sidewall;

a spring coupled to the rotating member and configured to bias the rotating member toward the first position of the rotating member;

a first pin configured to couple the rotating member to the sidewall and to the spring, the first pin being further configured to be positioned within the first and second slots; and a second pin configured to couple the rotating member to the sidewall, wherein the rotating member is further configured to rotate about the second pin during operation.

15. The closing spring assembly of claim 14, wherein:

the rotating member is further configured to, during operation, exert a force on the shaft in response to the bias of the spring;

the force will bias the shaft toward the first position of the shaft; and the force will remain substantially constant or decreases as the shaft moves from the first to the second position of the shaft.

16. The closing spring assembly of claim 14, wherein:

the spring is a coil spring; and the rotating member is further configured so that a longitudinal axis of the spring moves toward the second pin as the rotating member moves from the first to the second position of the rotating member during operation.

17. The closing spring assembly of claim 14, wherein the first pin is configured to translate in relation to the sidewall and the rotating member within the respective first and second slots as the rotating member moves from the first to the second position of the rotating member during operation.

18. The closing spring assembly of claim 14, wherein:

the shaft is configured to move between the first and second positions in a horizontal direction during operation; and the rotating member is configured so that the first pin remains lower than the second pin as the rotating member moves from the first to the second position of the rotating member during operation.

19. The closing spring assembly of claim 14, wherein:

the shaft is configured to move between the first and second positions in a horizontal direction during operation; and the second slot has a substantially horizontal orientation when the rotating member is in the first position of the rotating member.

* * * * *